US010208737B1

(12) United States Patent
Freeman

(10) Patent No.: US 10,208,737 B1
(45) Date of Patent: Feb. 19, 2019

(54) UNIFORMLY PRESSURIZED THERMAL ENERGY RECOVERY SYSTEMS

(71) Applicant: Walter B. Freeman, Cave Junction, OR (US)

(72) Inventor: Walter B. Freeman, Cave Junction, OR (US)

( * ) Notice: Subject to any disclaimer, the term of this patent is extended or adjusted under 35 U.S.C. 154(b) by 0 days.

(21) Appl. No.: 15/801,710

(22) Filed: Nov. 2, 2017

Related U.S. Application Data

(63) Continuation-in-part of application No. 13/653,360, filed on Oct. 16, 2012, now Pat. No. 9,835,145.

(60) Provisional application No. 61/551,359, filed on Oct. 25, 2011.

(51) Int. Cl.

| | |
|---|---|
| ***F01B 17/04*** | (2006.01) |
| ***F01L 21/02*** | (2006.01) |
| ***F04B 9/105*** | (2006.01) |
| ***F04B 9/113*** | (2006.01) |
| ***F04B 9/133*** | (2006.01) |
| ***F04B 43/113*** | (2006.01) |

(52) U.S. Cl.
CPC ..... *F04B 9/113* (2013.01); *F04B 9/105* (2013.01); *F04B 9/133* (2013.01); *F04B 43/113* (2013.01); *F01B 17/04* (2013.01); *F01L 21/02* (2013.01)

(58) Field of Classification Search
CPC ... F04B 9/113; F04B 43/1136; F04B 43/1133; F04B 43/113; F04B 9/125; F04B 9/1253; F04B 9/1256
USPC ..... 60/645, 655, 659; 417/379, 397, 403
See application file for complete search history.

(56) References Cited

U.S. PATENT DOCUMENTS

| | | | |
|---|---|---|---|
| 153,296 | A | 7/1874 | Atkinson |
| 213,615 | A | 3/1879 | Blake |
| 330,388 | A | 11/1885 | Dow |
| 391,941 | A | 10/1888 | Brown |
| 969,027 | A | 8/1910 | Benson |
| 1,437,704 | A | 12/1922 | Barrance |
| 1,748,445 | A | 11/1927 | Fandt |
| 1,690,126 | A | 11/1929 | Nieleback |

(Continued)

FOREIGN PATENT DOCUMENTS

| | | |
|---|---|---|
| GB | 2334076 | 8/1999 |
| WO | WO2010149972 | 12/2010 |

*Primary Examiner* — Mark A Laurenzi
*Assistant Examiner* — Mickey H France
(74) *Attorney, Agent, or Firm* — Jerry Haynes Law

(57) ABSTRACT

Thermal energy recovery systems include a piston assembly including a primary cylinder adapted to receive vapor; a single-acting secondary cylinder/piston assembly extending from opposite ends of the primary cylinder; a primary piston disposed for displacement in the primary cylinder; first and second secondary pistons disposed for displacement in the secondary cylinder/piston; and a piston connecting member connecting the first and second secondary pistons to the primary piston. Alternatively, a secondary piston is of the type of a double-acting piston for a more compact reciprocating function to reduce piston friction losses. Metering valves regulate the vapor pressure being introduced into displacement volume chambers at a constant pressure. A working fluid pressure-tank/accumulator/transfer-conduit is in communication with the displacement volume chambers to help regulate pressure of the working fluid. A working fluid transfer conduit forms integrally with the working fluid pressure-tank/accumulator to reduce fluid friction losses.

20 Claims, 5 Drawing Sheets

(56) References Cited

U.S. PATENT DOCUMENTS

| | | | |
|---|---|---|---|
| 1,746,104 | A | 2/1930 | Chritiansen |
| 1,962,986 | A | 6/1934 | Dole |
| 1,979,161 | A | 10/1934 | Klein et al. |
| 2,134,466 | A | 10/1938 | Lentz et al. |
| 2,264,518 | A | 1/1941 | Foster |
| 2,652,034 | A | 5/1950 | Baillot et al. |
| 3,609,061 | A | 9/1971 | Peoples |
| 4,204,406 | A | 5/1980 | Hopfe |
| 4,272,226 | A | 6/1981 | Osborne |
| 5,832,728 | A | 11/1998 | Buck |
| 5,984,642 | A | 11/1999 | Danielsson |
| 6,481,393 | B1 | 11/2002 | Drew |
| 7,413,418 | B2 | 8/2008 | Lane et al. |
| 7,472,544 | B1 | 1/2009 | Knight |
| 7,900,444 | B1 | 3/2011 | McBride et al. |
| 2006/0174613 | A1 | 8/2006 | Pritchard |
| 2008/0110171 | A1 | 5/2008 | Schmeltz |
| 2011/0100213 | A1 | 5/2011 | Finkerath et al. |
| 2011/0308248 | A1 | 12/2011 | Stoganov |

UNIFORMLY PRESSURIZED THERMAL ENERGY RECOVERY SYSTEMS

CROSS-REFERENCE TO RELATED APPLICATIONS

This application is a continuation-in-part application of U.S. application Ser. No. 13/653,360, filed Oct. 16, 2012 and entitled THERMAL ENERGY RECOVERY SYSTEMS, which claims benefit of U.S. provisional application No. 61/551,359, filed Oct. 25, 2011 and entitled THERMAL ENERGY RECOVERY SYSTEMS, which continuation-in-part and provisional applications are incorporated by reference herein in their entirety

FIELD OF THE INVENTION

Illustrative embodiments of the disclosure generally relate to systems which exploit thermal energy for various purposes. More particularly, illustrative embodiments of the disclosure relate to thermal energy recovery systems which render thermal energy available for a variety of purposes.

BACKGROUND OF THE INVENTION

Thermal energy is useful in a variety of applications such as heating and cooking. In some applications, it may be desirable to exploit thermal energy which is obtained from a readily-available thermal energy source for various purposes.

Accordingly, thermal energy recovery systems which render thermal energy available for a variety of purposes may be desirable for some applications.

SUMMARY OF THE INVENTION

Illustrative embodiments of the disclosure are generally directed to thermal energy recovery systems. An illustrative embodiment of the thermal energy recovery system includes a piston assembly including a primary cylinder adapted to receive vapor or hot liquid in such a state or condition as to become vapor; a secondary cylinder extending from the end of the primary cylinder; a primary piston disposed for displacement in the primary cylinder; a double-acting secondary piston disposed for displacement in the secondary cylinder; and a piston connecting member connecting the double-acting secondary piston to the primary piston.

An alternative illustrative embodiment of a uniformly pressurized thermal energy recovery system includes a vapor source generating a vapor from a liquid; a vapor delivery conduit in communication with the vapor source; a primary displacement volume chamber containing a double-action piston in communication with the vapor delivery conduit, the primary displacement volume chamber adapted to receive the vapor or the liquid in such a state so as to become vapor from the vapor source; a vapor delivery control valve operational on the vapor delivery conduit, the vapor delivery control valve regulating flow of the vapor; a plurality of vapor metering valves disposed at opposite ends of the primary displacement volume chamber, the vapor metering valves regulating flow rate and pressure of the vapor into the primary displacement volume chamber, whereby the vapor metering valves enable uniform flow of the vapor into the primary displacement volume chamber; a primary piston sealingly engaging an interior surface of primary displacement volume chamber, the primary double action piston adapted for slidable displacement between the opposite ends of the primary displacement volume chamber, whereby pressure is applied to the primary piston. The pressure ratio amplifying a pressure exerted on the primary piston; a secondary double action displacement volume chamber mechanically connected to the primary displacement volume chamber through a connecting rod, the secondary displacement volume chamber containing a working fluid; at least one working fluid inlet check valve operatively fitted to the secondary displacement volume chamber, the working fluid inlet check valve regulating flow of working fluid into the secondary displacement volume chamber; a double-acting secondary piston sealingly engaging an interior surface of secondary displacement volume chamber, the double-acting secondary piston adapted for slidable displacement between the opposite ends of the secondary displacement volume chamber, whereby the pressurized working fluid is generated by the second piston mechanically connected to the primary piston operating in the primary displacement volume chamber; a condenser disposed in fluid communication with the primary displacement volume chamber through one or more spent vapor exhaust valves, the condenser being in fluid communication with the vapor source, the condenser, in some applications, condenses the vapor for return to the vapor source. Condensing the vapor on the non-pressurized side of the primary piston causes an increased pressure differential applied to the primary piston; a working fluid pressure tank disposed in fluid communication with the secondary displacement volume chamber, the working fluid pressure tank regulating pressure of the working fluid and also serving as the working fluid transfer conduit attached to the pressure tank working fluid transfer conduit transferring the working fluid from the secondary displacement volume chamber to the turbine/motor, whereby the integration of the working fluid pressure tank with the working fluid transfer conduit helps reduce fluid friction loss for the flowing working fluid; at least one working fluid outlet check valve operatively fitted to the working fluid pressure tank, the working fluid outlet check valve regulating flow of the working fluid from the secondary displacement volume chamber to the working fluid pressure tank; a turbine/motor disposed in fluid communication with the working fluid pressure tank, the turbine/motor powered by the working fluid; and a working fluid reservoir disposed in fluid communication with the turbine/motor, the working fluid reservoir further being in fluid communication with the working fluid inlet check valve of the secondary displacement volume chamber.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Figure 1:
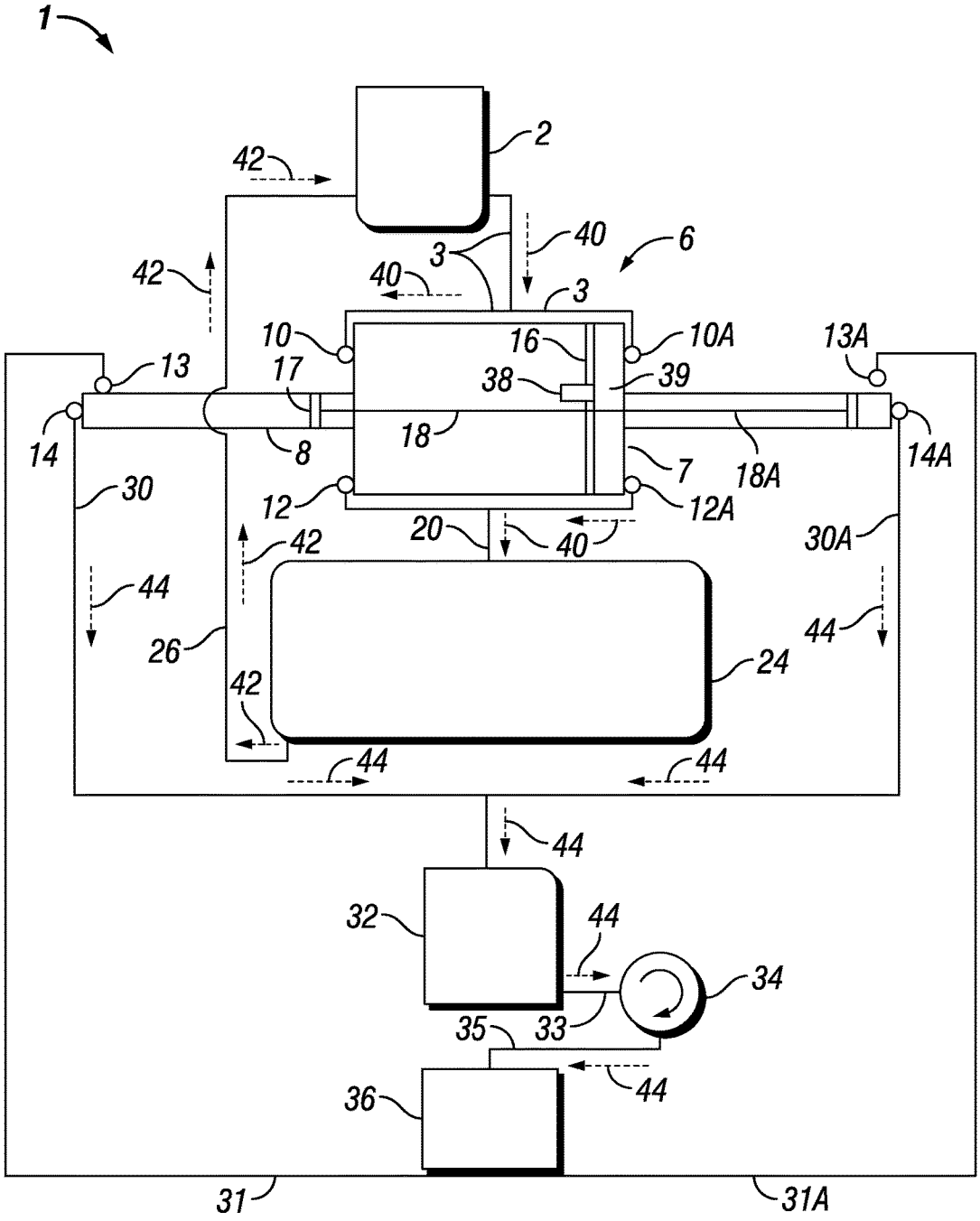
FIG. 1 is a block diagram of an illustrative embodiment of a thermal energy recovery system.

Referring initially to FIG. 1 of the drawings, an illustrative embodiment of a thermal energy recovery system is generally indicated by reference numeral 1. The thermal energy recovery system 1 may include a boiler 2 which in some embodiments may be adapted to form vapor 40 from a liquid 42. In other embodiments, the boiler 2 may be adapted to receive vapor 40 from a vapor source (not illustrated). A piston assembly 6 may include a primary cylinder 7 which may have a generally elongated, cylindrical configuration and a double-acting secondary cylinder 8 which may extend from opposite ends of the primary cylinder 7. Cylinder inlet valves 10, 10*a* may be provided at opposite ends of the primary cylinder 7. Alternatively, a liquid injection system can be used in conjunction with or in place of inlet valves. The cylinder inlet valves 10, 10*a* may be disposed in fluid communication with the boiler 2 through boiler outlet conduits 3. Cylinder outlet valves 12, 12*a* may be provided at opposite ends of the primary cylinder 7. The cylinder outlet valves 12, 12*a* may be disposed generally in opposite or diametrically-opposed relationship to the cylinder inlet valves 10, 10*a*, and/or liquid injection system, respectively.

A primary piston 16 may sealingly engage the interior surface of the primary cylinder 7. The primary piston 16 may be adapted for slidable displacement between the opposite ends of the primary cylinder 7. A double-acting secondary piston 17 may sealingly and slidably engage the interior surface of the secondary cylinder 8. Piston connecting members 18, 18*a* may connect the primary piston 16 to the double-acting secondary piston 17.

In one embodiment a pressure sensor 38 is operationally attached to the primary piston 16. The pressure sensor 38 is used to control at least one valve 39 that regulates the flow of vapor (or a liquid in a thermodynamic state as to become vapor) into the primary cylinder 7. The purpose for this valve fluid flow regulation is to control the flow and expansion of the vapor into a uniform pressure that is applied to the primary piston 16. This creates a more efficient axial reciprocation by primary piston 16.

In one embodiment, at least one of the pressure sensors 38 is in fluid communication with the pressurized working fluid contained in the pressurized working fluid tank 32. The pressure sensors 38 is provided to control the inlet valve 39, which serves as a throttle to control the flow of vapor or liquid in such a thermodynamic condition as to become a vapor to the primary displacement volume. Thus, the purpose of the pressure sensor 38 and the pressure sensor controlled throttle is to ensure that the amount of volume or uniformly pressurized working fluid delivered to the turbine/motor remains constant under potentially variable load conditions to which the turbine/motor may be subjected.

A condenser 24 may be disposed in fluid communication with the cylinder outlet valves 12, 12*a* on the primary cylinder 7 of the piston assembly 6 through an exhaust manifold 20. The boiler 2 may be disposed in fluid communication with the condenser 24 through a boiler return conduit 26.

The secondary cylinder 8 may be fitted with an inlet check valve 13 and an outlet check valve 14. Secondary cylinder 8 may also be fitted with an inlet check valve 13*a* and an outlet check valve 14*a*. A pressure tank 32 may be disposed in fluid communication with the outlet check valve 14 through a pressure conduit 30 and with the outlet check valve 14*a* through a pressure conduit 30*a*. In one embodiment, the pressure tank 32 is integrally formed with the pressure conduit 30 to reduce internal fluid friction losses. A turbine/motor 34 may be disposed in fluid communication with the pressure tank 32 through a turbine/motor inlet conduit 33. The turbine/motor 34 may be used to perform work in any of a variety of applications. A fluid reservoir 36 may be disposed in fluid communication with the turbine/motor 34 through a turbine outlet conduit 35. An inlet check valve 13 of the secondary cylinder 8 may be disposed in fluid communication with the fluid reservoir 36 through a working fluid return conduit 31. An inlet check valve 13*a* of the secondary cylinder 8 may also be disposed in fluid communication with the fluid reservoir 36 through a working fluid return conduit 31*a*.

In exemplary operation of the thermal energy recovery system 1, a working fluid 44 is contained in the secondary cylinder 8 of the piston assembly 6. In some applications, the working fluid 44 may be a liquid. In some applications, the working fluid 44 may be a gas. The boiler 2 heats the water or other liquid 42 which subsequently becomes vapor 40 or alternatively, receives the vapor 40 from a vapor source (not illustrated). The cylinder inlet valve and/or liquid injection system 10 and the cylinder outlet valve 12*a* are opened whereas the cylinder inlet valve 10*a* and the cylinder outlet valve 12 are closed. Accordingly, the vapor 40 and/or evaporative liquid enter the primary cylinder 7 through the cylinder inlet valve and/or liquid injection system 10 such that the vapor 40 applies differential pressure against the primary piston 16, causing movement of the piston 16 in the primary cylinder 7 to the right in FIG. 1. In that the vapor 40 on the exhaust side of the primary piston 16 passes through the exhaust manifold 20 to the condenser 24 and is condensed therein, the pressure differential applied to the primary piston 16 is enhanced, allowing for expansion of the working vapor 40 potentially to less than atmospheric pressure. This feature may allow for maximum expansion of the working vapor 40, resulting in increased operational efficiency. This action causes the primary piston 16 to exert pressure against the double-acting secondary piston 17 through the piston connecting member 18*a*. Consequently, the piston connecting member 18*a* pushes the double-acting secondary piston 17 in the secondary cylinder shown in FIG. 1. The double-acting secondary piston 17 displaces the working fluid 44 from the secondary cylinder 8 through the outlet check valve 14*a* and the pressure conduit 30*a*, respectively, into and through the pressure tank 32. At least one pressure sensor which is in fluid communication with the pressurized working fluid tank, whereby the sensor is provided to control the inlet valve which serves as a throttle to control the flow of vapor or a liquid in such a thermodynamic condition as to become a vapor to the primary displacement volume. The purpose of the pressure sensor and the pressure sensor controlled throttle is to ensure that the amount/volume of uniformly pressurized working fluid delivered to the turbine/motor remains constant under potentially variable load conditions to which the turbine/motor may be subjected. The pressurized working fluid 44 exits the pressure tank 32 through the turbine inlet conduit 33 and flows through and rotates the turbine/motor 34. The working fluid 44 leaves the turbine/motor 34 through the turbine outlet conduit 35 and enters the fluid reservoir 36. From the fluid reservoir 36, the working fluid return conduit 31*a* returns the working fluid 44 to the secondary cylinder 8 through the working fluid return conduit 31 and the inlet check valve 13, respectively, due to the drop in pressure in the secondary cylinder 8 caused by retraction of the double-acting secondary piston 17.

The differential or ratio of the pressure which is applied by the vapor 40 against the primary piston 16 to the pressure which is applied by the double-acting secondary piston 17 against the working fluid 44 is directly proportional to the square of the radius of the primary piston 16 and the double-acting secondary piston 17. The pressure which the double-acting secondary piston 17 exerts against the working fluid 44 is equal to the pressure which the vapor 40 exerts against the primary piston 16 times the area of the primary piston 16 divided by the area of the double-acting secondary piston 17. For example and without limitation, in embodiments in which the diameter of the primary piston 16 is 10 inches and the diameter of the double-acting secondary piston 17 is 1 inch, the area of the primary piston 16 ($A=\pi r^2$) is 78.5 $in^2$ less the area of the piston connecting member 18*a*. The area of the double-acting secondary piston 17 is 0.785 $in^2$. Therefore, a pressure of 10 lbs./$in^2$ applied to the primary piston 16 yields a pressure of 1,000 PSI developed by the double-acting secondary piston 17 (a ratio of 100:1). Piston sizes (primary versus double-acting secondary) can be designed so as to optimize working fluid pressures in order to maximize thermal and mechanical efficiency.

As it moves to the right in FIG. 1, the primary piston 16 forces vapor 40 from the primary cylinder 7 through the open cylinder outlet valve 12*a*. The exhaust manifold 20 distributes the vapor 40 into the condenser 24, where the vapor 40 is condensed into the liquid 42. As the vapor 40 condenses, its pressure is reduced, resulting in lower vapor pressure on the exhaust side of the primary piston 16. This, in turn, increases the differential pressure on the primary piston 16. The boiler return conduit 26 returns the liquid 42 to the boiler 2 and the process is repeated. In the subsequent power cycle of the piston assembly 6, the cylinder inlet valve and/or liquid injection system 10*a* and the cylinder outlet valve 12 may open while the cylinder inlet valve 10 and the cylinder outlet valve 12*a* may be closed. Vapor 40 from the boiler 2 forces the primary piston 16 to the left in FIG. 1 such that the double-acting secondary piston 17 expels the working fluid 44 from the secondary cylinder 8 and through the pressure conduit 30, the pressure tank 32, the turbine inlet conduit 33, the turbine/motor 34, the turbine outlet conduit 35 and the fluid reservoir 36, respectively. From the fluid reservoir 36, the working fluid return conduit 31 returns the working fluid 44 to the secondary cylinder 8 through the working fluid return conduit 31*a* and the inlet check valve 13*a*, respectively, due to the drop in pressure in the secondary cylinder 8 caused by retraction of the double-acting secondary piston 17. Accordingly, as it reciprocates in the primary cylinder 7, the primary piston 16 alternately actuates the double-acting secondary piston 17 to maintain a continuous flow of working fluid 44 through the turbine/motor 34. In some applications, the rotating turbine/motor 34 may be used to perform some type of work (such as augmenting a drive train on a vehicle or generating electrical power, for example and without limitation). In other applications, the turbine/motor 34 may operate to compress gas according to the knowledge of those skilled in the art.

Figure 2:
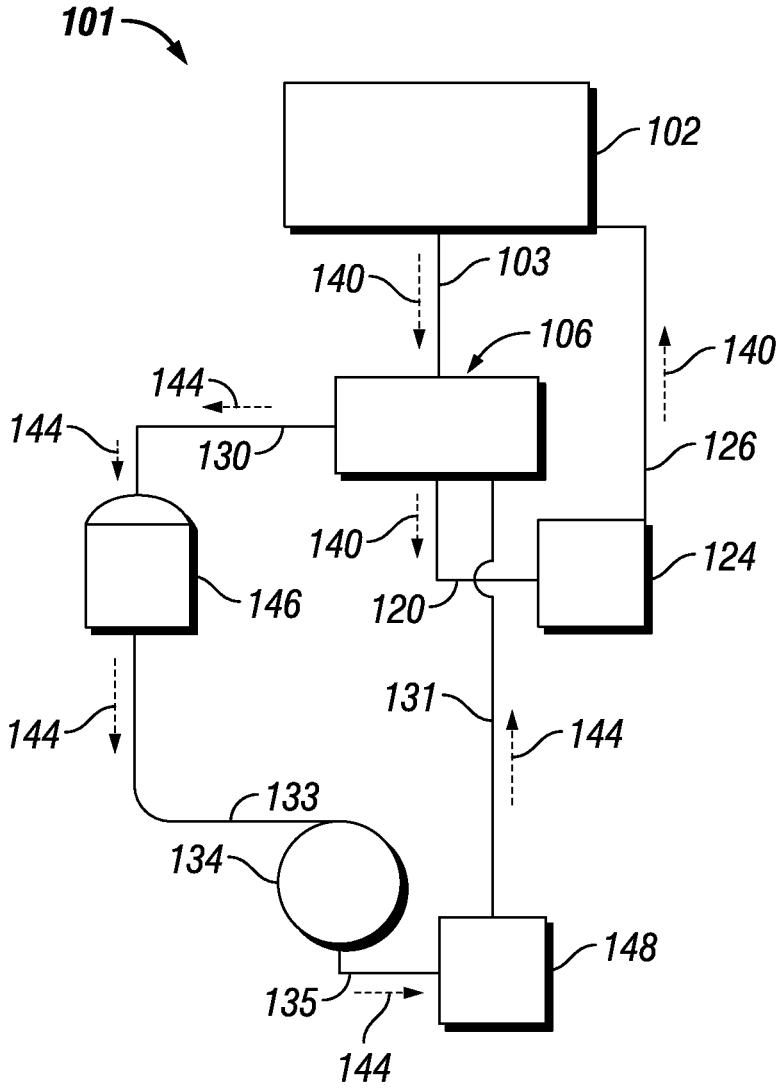
FIG. 2 is a block diagram of an alternative illustrative embodiment of the thermal energy recovery system.

Referring next to FIG. 2 of the drawings, an alternative illustrative embodiment of the thermal energy recovery system is generally indicated by reference numeral 101. In FIG. 2, components which are analogous to the corresponding components of the thermal energy recovery system 1 in FIG. 1 are designated by the same numerals in the 101-199 series. The thermal energy recovery system 101 may include a boiler 102. The boiler 102 may be an exhaust boiler, a solar thermal array, a dedicated boiler or a geothermal source, for example and without limitation. A primary cylinder 7 (FIG. 1) of a piston assembly 106 may be disposed in fluid communication with the boiler 102 through a boiler outlet conduit 103. A condenser 124 may be disposed in fluid communication with the primary cylinder 7 of the piston assembly 106 through an exhaust manifold 120. The boiler 102 may be disposed in fluid communication with the condenser 124 through a boiler return conduit 126.

A working fluid surge reservoir 146 may be disposed in fluid communication with a secondary cylinder 8 (FIG. 1) of the piston assembly 106 through a pressure conduit 130. A turbine/motor 134 may be disposed in fluid communication with the working surge reservoir 146 through a turbine inlet conduit 133. A working fluid return reservoir 148 may be disposed in fluid communication with the turbine/motor 134 through a turbine outlet conduit 135. Second secondary cylinder 8 of the piston assembly 106 may be disposed in fluid communication with the working fluid/return reservoir 148 through a working fluid return conduit 131.

In exemplary operation of the thermal energy recovery system 101, the boiler 102 heats a liquid which subsequently becomes vapor 140 or receives the vapor 140 from a separate vapor source (not illustrated). The vapor 140 flows from the boiler 102 through the boiler outlet conduit 103 into the piston assembly 106, which functions as was heretofore described with respect to the piston assembly 6 of the thermal energy recovery system 1 in FIG. 1. The vapor 140 flows to the condenser 124 through the exhaust manifold 120 and is condensed to form the liquid 140 in the condenser 124. The liquid 140 returns to the boiler 102 through the boiler return conduit 126.

Responsive to operation of the piston assembly 106, pressurized working fluid 144 flows through the pressure conduit 130 into the working fluid surge reservoir 146. From the working fluid surge reservoir 146, the working fluid 144 flows through the turbine inlet conduit 133 and the turbine/motor 134, respectively, rotating the turbine/motor 134. The working fluid 144 flows from the turbine/motor 134 through the turbine outlet conduit 135 and into the working fluid return reservoir 148. Finally, the working fluid return conduit 131 returns the working fluid 144 to the piston assembly 106.

Figure 3:
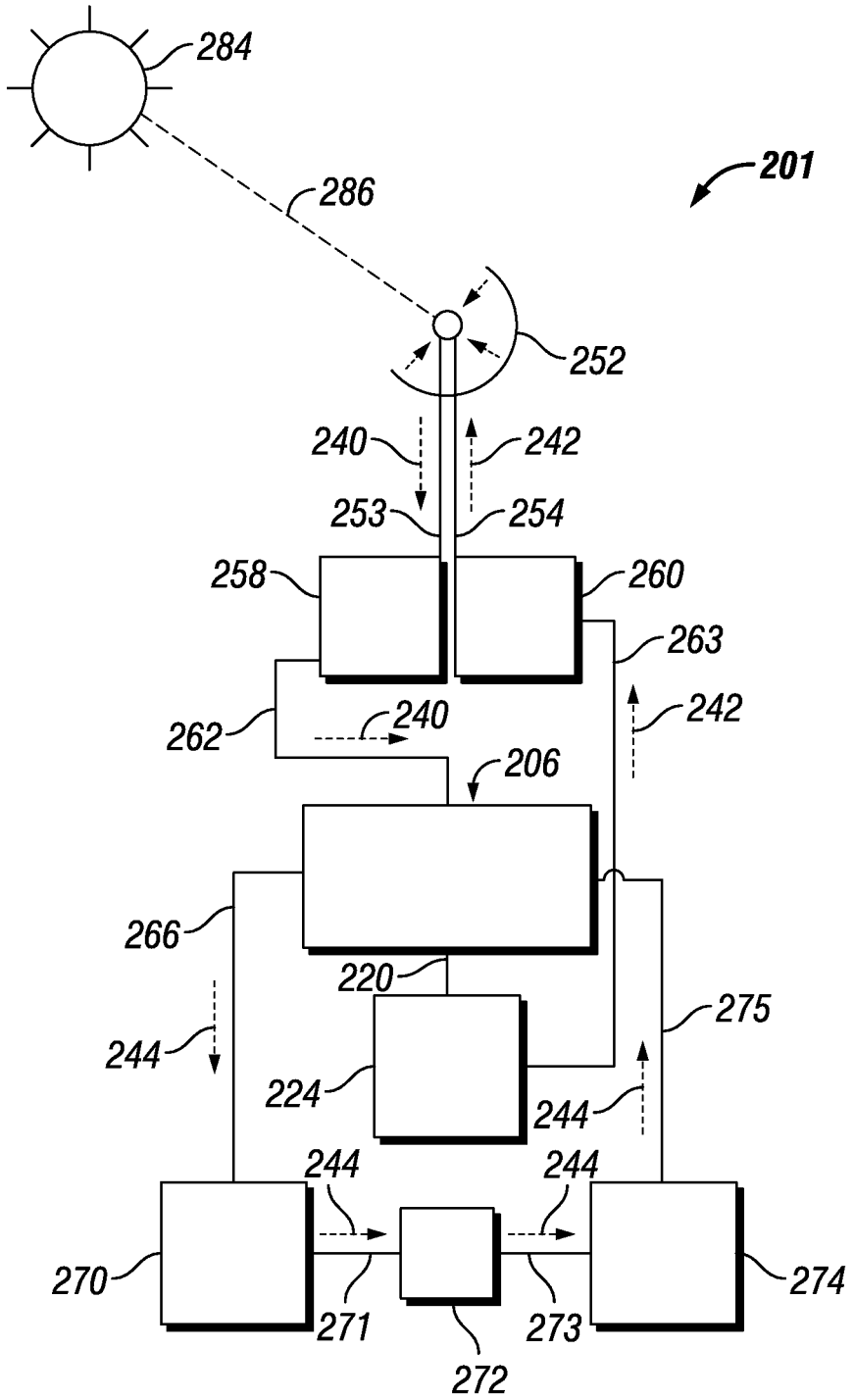
FIG. 3 is a block diagram of an illustrative embodiment of a solar-powered air-conditioning system.

Referring next to FIG. 3 of the drawings, an illustrative embodiment of a solar-powered air conditioning system is generally indicated by reference numeral 201. In FIG. 3, components which are analogous to the corresponding components of the thermal energy recovery system 1 in FIG. 1 are designated by the same numerals in the 201-299 series. The solar-powered air conditioning system 201 may include a solar thermal energy collector 252. A collector outlet conduit 253 and a collector return conduit 254 may be disposed in fluid communication with each other and in thermally-conductive contact with the solar thermal energy collector 252. A hot liquid storage tank 258 may be disposed in fluid communication with the collector outlet conduit 253. A cold liquid storage tank 260 may be disposed in fluid communication with the collector return conduit 254. The primary cylinder 7 (FIG. 1) of a piston assembly 206 may be disposed in fluid communication with the hot liquid storage tank 258 through a storage tank outlet conduit 262.

A condenser 224 may be disposed in fluid communication with the primary cylinder 7 of the piston assembly 206 through an exhaust manifold 220. The cold liquid storage tank 260 may be disposed in fluid communication with the condenser 224 through a storage tank return conduit 263.

A radiator 270 may be disposed in fluid communication with a secondary cylinder 8 (FIG. 3) of the piston assembly 206 through an assembly outlet conduit 266. A refrigerant storage tank 272 may be disposed in fluid communication with the radiator 270 through a radiator outlet conduit 271. An evaporator 274 may be disposed in fluid communication with the refrigerant storage tank 272 through a refrigerant outlet conduit 273. The secondary cylinder 8 (FIG. 1) of the piston assembly 206 may be disposed in fluid communication with the evaporator 274 through an assembly return conduit 275.

In exemplary operation of the solar-powered air conditioning system 201, thermal energy 286 emitted by the Sun 284 heats the thermal energy collector 252. Liquid 242 which flows through the thermal energy collector 252 is heated to produce hot liquid 240, which flows through the collector outlet conduit 253 to the hot liquid storage tank 258. The hot liquid 240 flows from the hot liquid storage tank 258 through the storage tank outlet conduit 262 to the piston assembly 206, where the liquid becomes vapor 240 actuates the piston assembly 206 as was heretofore described with respect to the piston assembly 6 in FIG. 1. From the piston assembly 206, the vapor 240 flows through the exhaust manifold 220 to the condenser 224, where the vapor 240 is condensed into liquid 242. The liquid 242 returns to the cold liquid storage tank 260 through the storage tank return conduit 263. Subsequently, the liquid 242 flows to the thermal energy collector 252 through the collector return conduit 254, and the process is repeated.

Responsive to flow of the vapor 240 into the piston assembly 206, the piston assembly 206 forces refrigerant gas 244 through the assembly outlet conduit 266 to the radiator 270. In the radiator 270, flowing air absorbs heat from the refrigerant gas 244, which then in a cooled state flows through the radiator outlet conduit 271 to the refrigerant storage tank 272. The refrigerant gas 244 flows through the refrigerant outlet conduit 273 to the evaporator 274, where the refrigerant gas 244 absorbs heat from flowing air and cools the air. The air which is cooled by the refrigerant gas 244 in the evaporator 274 may be distributed into an enclosed or partially enclosed space such as rooms (not illustrated) of a home or other building through ductwork or the like to cool the building typically in the same manner as a conventional air conditioning system. The refrigerant gas 244 returns to the piston assembly 206 through the assembly return conduit 275 and the process is repeated.

Figure 4:
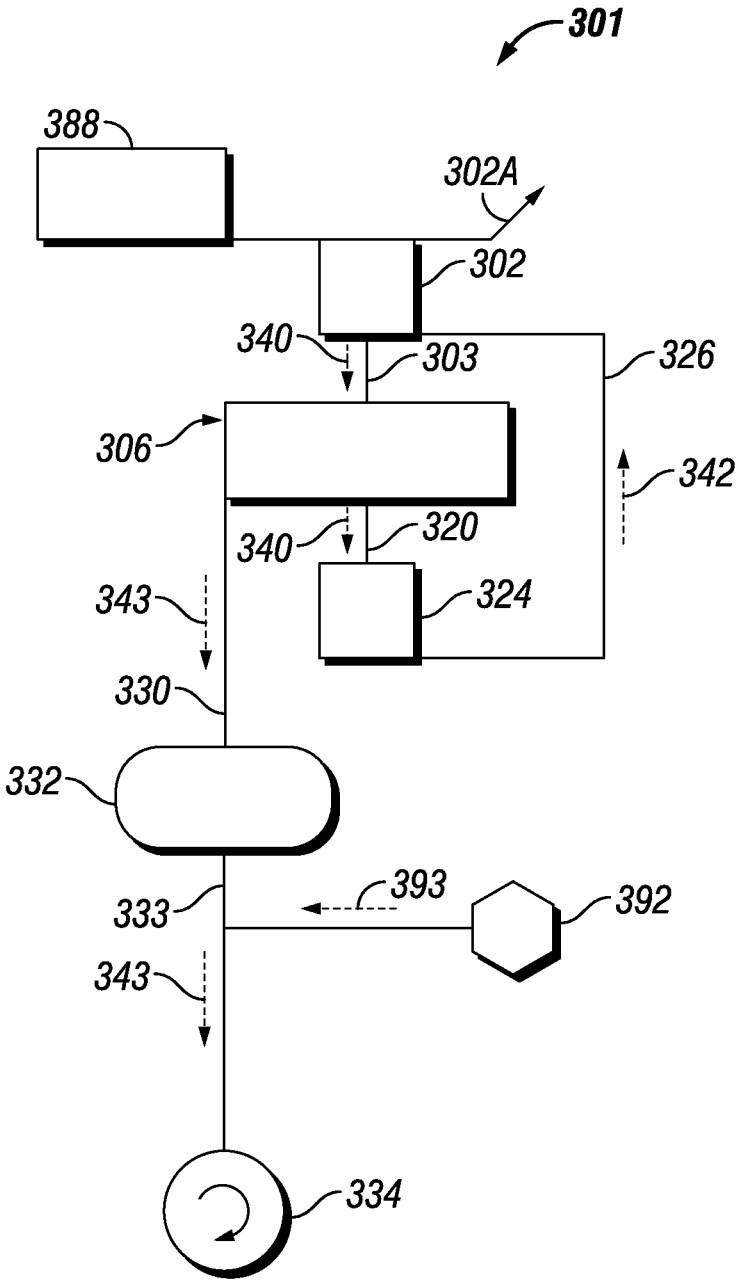
FIG. 4 is a block diagram of an illustrative embodiment of a vehicle propulsion system.

Referring next to FIG. 4 of the drawings, an illustrative embodiment of a propulsion system for road and rail vehicles is generally indicated by reference numeral 301. In FIG. 4, components which are analogous to the corresponding components of the thermal energy recovery system 1 in FIG. 1 are designated by the same numerals in the 301-399 series. The propulsion system 301 may include a turbine/motor 388 which in some applications may be the primary mover of a road or rail vehicle. In some embodiments, the turbine/motor 388 may include an internal combustion engine. A boiler 302 may be disposed in thermal contact with the turbine/motor 388 or with exhaust gas 302*a* from the turbine/motor 388.

The primary cylinder 7 (FIG. 1) of a piston assembly 306 may be disposed in fluid communication with the boiler 302 through a boiler outlet conduit 303. A condenser 324 may be disposed in fluid communication with the primary cylinder 7 of the piston assembly 306 through an exhaust manifold 320. The boiler 302 may be disposed in fluid communication with the condenser 324 through a boiler return conduit 326.

A pressurized air or other gaseous medium storage tank 332 may be disposed in fluid communication with a secondary cylinder 8 (FIG. 1) of the piston assembly 306 through a pressure conduit 330. A turbine/motor 334 may be disposed in fluid communication with the pressurized air or gaseous medium storage tank 332 through a turbine inlet conduit 333. In some applications, the turbine/motor 334 may drivingly engage a vehicle drive train (not illustrated) of the road or rail vehicle to augment the driving power of the turbine/motor 388. The turbine/motor 334 may additionally be coupled to the braking system (not illustrated) of the road or rail vehicle for regenerative braking purposes according to the knowledge of those skilled in the art. In some embodiments, an external air compressor 392 may be disposed in fluid communication with the turbine inlet conduit 333 between the pressurized air storage tank 332 and the turbine/motor 334.

In exemplary operation of the propulsion system 301, the turbine/motor 388 may be operated as the primary mover of the road or rail vehicle. Exhaust gases 302*a* from the turbine/motor 388 heats the boiler 302 such that liquid 342 in the boiler 302 is heated and subsequently becomes vapor 340. The vapor 340 flows through the boiler outlet conduit 303 to the piston assembly 306, which is operated in a manner similar to that heretofore described with respect to the piston assembly 6 in FIG. 1. From the piston assembly 306, the vapor 340 flows through the exhaust manifold 320 to the condenser 324, where the vapor 340 is condensed into liquid 342. The liquid 342 returns to the boiler 302 through the boiler return conduit 326 and the process is repeated.

Responsive to flow of the vapor 340 into the piston assembly 306, the piston assembly 306 compresses and forces air or gaseous medium 343 through the pressure conduit 330 to the pressurized gas storage tank 332. The compressed gas 343 flows from the pressurized gas storage tank 332 through the turbine inlet conduit 333 to the turbine/motor 334 and drives the turbine/motor 334. In some applications, the turbine/motor 334 may drive the vehicle drive train (not illustrated) of the road or rail vehicle to augment the driving power of the turbine/motor 388. In some applications, the turbine/motor 334 may be reversible to provide regenerative braking capability according to the knowledge of those skilled in the art. In some applications, such as under circumstances in which the turbine/motor 388 is not being operated, for example, the external gas compressor 392 may be operated to force compressed gas 393 to the turbine/motor 334 through the turbine inlet conduit 333.

Figure 5:
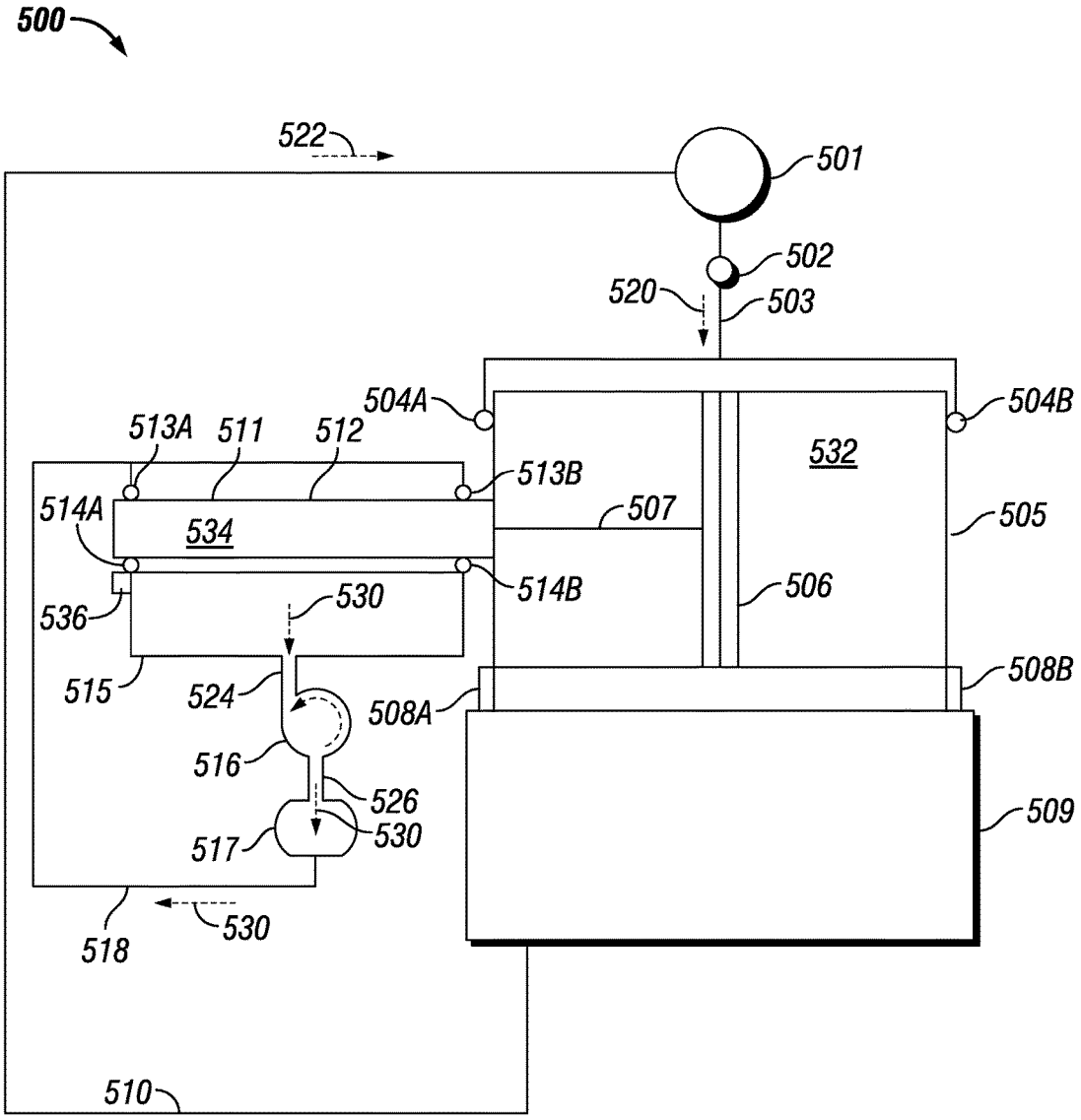
FIG. 5 is a block diagram of an illustrative embodiment of an alternative thermal energy recovery system.

Referring next to FIG. 5 of the drawings, an alternative illustrative embodiment of a uniformly pressurized thermal energy recovery system 500 is generally indicated by reference numeral 500. In FIG. 5, components which are analogous to the corresponding components of the thermal energy recovery system 1 in FIG. 1 are designated by the same numerals in the 500-536 series.

This alternative uniformly pressurized thermal energy recovery system 500 is unique in introducing a constant supply of vapor 520 into a primary displacement volume chamber 505 containing the primary piston 506 which is connected by a connecting rod 507 to the secondary piston 512 which operates in the secondary displacement volume which contains a working fluid. The uniform displacement of the primary piston 506 by the vapor 520 creates a more efficient differential pressure against the pistons 506, 512 as they are reciprocate through application of differential pressures.

To further enhance the constant, uniform supply of vapor 520 into the displacement volume chambers 505, 511, the system 500 provides a plurality of metering valve 504A, 504B to regulate the vapor pressure. By regulating vapor pressure with such valves 504A-B, vapor 520 is introduced into the displacement volume chambers 505, 511 at a constant pressure. This more efficient displacement of pistons 506, 512 results in a more uniform flow of working fluid 530 that is exerted by a double-acting secondary piston 512. The more uniform and consistent working fluid 530 is effective for operating a turbine/motor 516 in an efficient manner.

The system 500 is also unique in that the double-acting secondary piston 512 is of the type of a double-acting piston, such that the working fluid 530 acts alternately on both sides of the double-acting secondary piston 512. Use of such a double-sided reciprocating piston allows for a more compact reciprocating function, which helps reduce piston friction losses.

The system 500 is also unique in the means for reducing fluid friction loss as the working fluid flows through the system. This is accomplished by integrating a working fluid transfer conduit with a working fluid pressure-tank/accumulator/transfer-conduit 515. These components are not separate, but rather integral. This removes an extra component, which helps reduce fluid friction loss as the working fluid 530 is displaced through the various conduits, tanks, and chambers of the system.

Looking again at FIG. 5, the thermal energy recovery system 500 includes a vapor source 501, such as a boiler or renewable energy heat source, which serves to heat a liquid 522 into a vapor 520 for expansion and work. The vapor source 501 may be adapted to form vapor 520 from the liquid 522 through addition of heat. In other embodiments however, the vapor source 501 may be adapted to receive vapor 520 from a secondary vapor source (not illustrated).

The vapor 520 travels through a vapor delivery conduit 503. A vapor delivery control valve 502 helps ensure uniform flow of the vapor 520 into a primary displacement volume chamber 505 that is in communication with the vapor delivery conduit 503. The vapor delivery control valve 502 enables precise vapor control to maximize heat recovery. The vapor delivery control valve 502 may include a check valve known in the art of vapor delivery and control.

A plurality of vapor metering valves 504A, 504B may be provided at opposite ends of the primary displacement volume chamber 505. The vapor metering valves 504A, 504B control the flow rate and vapor pressure. By regulating vapor pressure, vapor 520 is introduced into the primary displacement volume chamber 505 at a constant pressure.

In some embodiments, the vapor metering valves 504A, 504B may include a float operated valve that opens and closes different sized vent ports at different vapor in a primary displacement volume chamber 505, discussed below. The vapor 520 passes through the vapor metering valves 504A, 504B before entering the primary displacement volume chamber 505.

A primary piston 506 may sealingly engage an interior surface 532 of primary displacement volume chamber 505. The primary piston 506 may be adapted for slidable displacement between the opposite ends of the primary displacement volume chamber 505. The primary displacement volume chamber 505 may have a generally elongated, cylindrical configuration adapted to slidably receive the primary piston 506.

The primary piston axially reciprocates within the primary displacement volume chamber 505 in response to vapor 520 introduced therein. The primary piston 506 may include a double-action piston known in the art.

A secondary displacement volume chamber 511 receives working fluid 530 through working fluid inlet check valve 513A, 513B that is operatively fitted to the secondary displacement volume chamber 511. The working fluid inlet check valve 513A, 513B regulates flow of working fluid into the secondary displacement volume chamber 511. The working fluid inlet check valve 513A, 513B may include, without limitation, a check valve, a clack valve, a non-return valve, a reflux valve, and a one-way valve that allows the working fluid 530 to flow through in only one direction.

A double-acting secondary piston 512 may sealingly and slidably engage an interior surface 534 of the secondary displacement volume chamber 511. The secondary displacement volume chamber 511 contains a working fluid 530 that forms as a result of the action of the double-acting secondary piston 512. The working fluid 530 that possesses sufficient pressure and velocity to drive a turbine/motor 516, as described below. In some embodiments, the secondary displacement volume chamber 511 may have an elongated cylindrical shape adapted to slidably receive the double-acting secondary piston 512.

Those skilled in the art will recognize that a double-acting secondary piston allows for a more compact reciprocating function, especially with the constant supply of vapor. This helps to reduce friction losses as the double-acting secondary piston 512 axially reciprocates in the secondary displacement volume chamber 511. A connecting rod 507 connects the primary piston 506 to the double-acting secondary piston 512, so as to enable reciprocating axial motion of the pistons 506, 512.

A condenser 509 may be disposed in fluid communication with the primary displacement volume chamber 505 through a plurality of spent vapor exhaust valves 508A, 508B. The vapor source 501 may be disposed in fluid communication with the condenser 509 through a condensate return conduit 510. The condenser may condense the vapor 520 for recycling back to the vapor source 501. This allows for more efficient use of the liquid 522. In some applications, such as the production of geothermal power, the condensate is not returned to the vapor source.

A working fluid pressure-tank/accumulator/transfer-conduit 515 may be disposed in fluid communication with the secondary displacement volume chamber 511. The working fluid pressure-tank/accumulator/transfer-conduit 515 works to regulate pressure of the working fluid 530 before release to a turbine/motor 516, discussed below. In some embodiments, the working fluid pressure-tank/accumulator/transfer-conduit 515 has sensors and valves and gauges for adjusting the amount of pressure contained therein.

The working fluid pressure-tank/accumulator/transfer-conduit 515 is unique in that it includes an integral working fluid transfer conduit. Thus, the pressure-tank/accumulator/transfer-conduit 515 is one-piece, working together to both carry and regulate the pressure of the working fluid 520. Thus, by integrating the working fluid transfer conduit with the working fluid pressure-tank/accumulator/transfer-conduit 515, fluid friction loss for the working fluid 530 is significantly reduced as the working fluid 530 flows from the secondary displacement volume chamber 511 to the working fluid pressure-tank/accumulator/transfer-conduit 515.

The working fluid pressure-tank/accumulator/transfer-conduit 515 may be fitted with at least one working fluid outlet check valve 514A, 514B. The working fluid outlet check valve 514A, 514B may include, without limitation, a check valve, a clack valve, a non-return valve, a reflux valve, and a one-way valve that allows the working fluid 530 to flow through in only one direction.

As discussed above, a turbine/motor 516 is disposed in fluid communication with the working fluid pressure-tank/accumulator/transfer-conduit 515 through a turbine/motor inlet conduit 524. The turbine/motor 516 may rotatably operate and be used to perform work in any of a variety of applications. In some applications, the turbine/motor 516 may be used to perform some type of work (such as augmenting a drive train on a vehicle or generating electrical power, for example and without limitation). In other applications, the turbine/motor 516 may operate to compress gas according to the knowledge of those skilled in the art.

A working fluid reservoir 517 may be disposed in fluid communication with the turbine/motor 516 through a turbine/motor outlet conduit 526. The working fluid inlet check valve 513A, 513B of the secondary displacement volume chamber 511 may be disposed in fluid communication with the working fluid reservoir 517 through a working fluid return line 518. The working fluid return line 518 carries the working fluid 530 back to the secondary displacement volume chamber 511 through the working fluid return line 518 and the working fluid inlet check valve 513A, 513B respectively.

In one embodiment a pressure sensor 536 is operationally attached to the primary piston. The pressure sensor 536 is used to control check valve 514A, 514B that regulates the flow of vapor (or a liquid in a thermodynamic state as to become vapor) into the primary cylinder. The purpose for this valve fluid flow regulation is to control the flow and expansion of the vapor into a uniform pressure that is applied to the primary piston. This creates a more efficient axial reciprocation by primary piston.

In exemplary operation of the thermal energy recovery system 500, a working fluid 530 is contained in the secondary displacement volume chamber 511. In some applications, the working fluid 530 may be a liquid. In some applications, the working fluid 530 may be a gas. The vapor source 501 heats the water or other liquid 522 which subsequently becomes vapor 520. In alternative embodiments, the vapor source 501 be operable as a renewable energy source, e.g., geothermal energy source, solar power, wind power, wave power, so as to heat the liquid 522.

The vapor delivery control valve 502 is opened. Accordingly, the vapor 520 and/or evaporative liquid enters the primary displacement volume chamber 505 through the vapor delivery control valve 502 such that the vapor 520 applies differential pressure against the primary piston 506, causing movement of the piston 506 in the primary vapor delivery control valve 502 to the right in FIG. 5.

The vapor exhaust from the exhaust side of the primary piston 506 and passes through the spent vapor exhaust valves 508A, 508B to the condenser 509 and is rapidly condensed therein. This causes the pressure differential applied to the primary piston 506 to be enhanced, allowing for expansion of the working vapor 520 potentially to less than atmospheric pressure.

This feature may allow for maximum expansion of the working vapor 520, resulting in increased operational efficiency. This action causes the primary piston 506 to exert pressure against the double-acting secondary piston 512 through the connecting rod 507. Consequently, the connecting rod 507 pushes the double-acting secondary piston 512 in the secondary displacement volume chamber 511 to the right in FIG. 5.

The double-acting secondary piston 512 displaces the working fluid 530 from the secondary displacement volume chamber 511 and an integrated working fluid pressure-tank/accumulator/transfer-conduit. Thus, by not having to pass through separate non-integrated working fluid conduit(s), the working fluid 530 experiences less fluid friction loss.

The working fluid 530 passes through the working fluid outlet check valve 514A, 514B into and through the working fluid pressure-tank/accumulator/transfer-conduit 515. The pressurized working fluid 530 exits the pressure-tank/accumulator/transfer-conduit 515 through the turbine/motor inlet conduit 524 and flows through and rotates the turbine/motor 516. The working fluid 530 leaves the turbine/motor 516 through the turbine/motor outlet conduit 526 and enters the working fluid reservoir 517.

From the fluid reservoir 517, the working fluid return line 518 returns the working fluid 530 to the secondary displacement volume chamber 511 through the working fluid return line 518 and the working fluid inlet check valve 513A, 513B, respectively, due to the drop in pressure in the secondary displacement volume chamber 511 caused by retraction of the double-acting secondary piston 512.

The differential or ratio of the pressure which is applied by the vapor 520 against the primary piston 506 to the pressure which is applied by the double-acting secondary piston 512 against the working fluid 530 is directly proportional to the square of the radius of the primary piston 506 and the double-acting secondary piston 512. The pressure which the double-acting secondary piston 512 exerts against the working fluid 530 is equal to the pressure which the vapor 520 exerts against the primary piston 506 times the area of the primary piston 506 divided by the area of the double-acting secondary piston 512. Piston sizes (primary versus secondary) can be designed so as to optimize working fluid pressures and maximize thermal efficiency.

As the primary piston 506 moves to the right in FIG. 5, the vapor 520 is forced out from the primary displacement volume chamber 505 through the open spent vapor exhaust valves 508A, 508B into the condenser 509. The spent vapor exhaust valves 508A, 508B distributes the vapor 520 into the condenser 509, where the vapor 520 is condensed into the liquid 522. As the vapor 520 condenses, its pressure is reduced, resulting in lower vapor pressure on the exhaust side of the primary piston 506. This, in turn, increases the differential pressure on the primary piston 506. The condensate return conduit 510 returns the liquid 522 to the vapor source 501 and the process is repeated.

In the subsequent power cycle, the vapor metering valve 504B and spent vapor exhaust valve 508A may open while the vapor metering valve 504A and spent vapor exhaust valve spent vapor exhaust valve 508B may be closed. Vapor 520 from the vapor source 501 forces the primary piston 506 to the left in FIG. 5 such that the double-acting secondary piston 512 expels the working fluid 530 from the secondary displacement volume chamber 511 and through the turbine/motor inlet conduit 524, the pressure-tank/accumulator/transfer-conduit 515, the turbine/motor inlet conduit 524, the turbine/motor 516, the turbine/motor outlet conduit 526 and the working fluid reservoir 517, respectively.

From the working fluid reservoir 517, the working fluid return line 518 returns the working fluid 530 to the secondary displacement volume chamber 511 through the working fluid return line 518 and the working fluid inlet check valve 513A, 513B respectively, due to the drop in pressure in the secondary displacement volume chamber 511 caused by retraction of the double-acting secondary piston 512.

While exemplary embodiments of the disclosure have been described above, it will be recognized and understood that various modifications can be made in the disclosure and the appended claims are intended to cover all such modifications which may fall within the spirit and scope of the disclosure.

What is claimed is:

1. A uniformly pressurized thermal energy recovery system, comprising:

a vapor source generating a vapor from a liquid;

a vapor delivery conduit in communication with the vapor source;

a primary displacement volume chamber in communication with the vapor delivery conduit, the primary displacement volume chamber adapted to receive the vapor or the liquid in such a state so as to become vapor from the vapor source;

a vapor delivery control valve operational on the vapor delivery conduit, the vapor delivery control valve regulating flow of the vapor;

a plurality of vapor metering valves disposed at opposite ends of the primary displacement volume chamber, the vapor metering valves regulating flow rate and pressure of the vapor into the primary displacement volume chamber, whereby the vapor metering valves enable uniform flow of the vapor into the primary displacement volume chamber;

a primary piston sealingly engaging an interior surface of primary displacement volume chamber, the primary piston adapted for slidable displacement between the opposite ends of the primary displacement volume chamber, whereby a pressure ratio is applied to the primary piston, the pressure ratio amplifying a pressure exerted on the primary piston;

a condenser disposed in fluid communication with the primary displacement volume chamber through a plurality of spent vapor exhaust valves, the condenser being in fluid communication with the vapor source, the condenser condensing the vapor with the resulting condensate being returned to the vapor source, whereby condensing the vapor causes an additional pressure differential to be applied to the primary piston;

a secondary displacement volume chamber containing a working fluid;

at least one working fluid inlet check valve operatively fitted to the secondary displacement volume chamber, the working fluid inlet check valve regulating flow of the working fluid into the secondary displacement volume chamber;

a double-acting secondary piston sealingly engaging an interior surface of secondary displacement volume chamber, the double-acting secondary piston adapted for slidable displacement between the opposite ends of the secondary displacement volume chamber;

a working fluid pressure tank disposed in fluid communication with the secondary displacement volume chamber, the working fluid pressure-tank/accumulator regulating pressure of the working fluid;

a working fluid transfer conduit formed integrally with the working fluid pressure-tank/accumulator, the working fluid transfer conduit carrying the working fluid from the secondary displacement volume chamber to a turbine/motor, whereby the integration of the working fluid pressure tank with the working fluid transfer conduit helps reduce fluid friction loss for the flowing working fluid;

at least one working fluid outlet check valve operatively fitted to the working fluid pressure tank, the working fluid outlet check valve regulating flow of the working fluid from the secondary displacement volume chamber to the working fluid pressure tank;

a turbine/motor disposed in fluid communication with the working fluid pressure tank, the turbine/motor powered by the working fluid; and a working fluid reservoir disposed in fluid communication with the turbine/motor, the working fluid reservoir further being in fluid communication with the working fluid inlet check valve of the secondary displacement volume chamber.

2. The system of claim 1, wherein the vapor source comprises a boiler.

3. The system of claim 1, wherein the vapor delivery control valve comprises a check valve.

4. The system of claim 1, wherein the primary piston axially reciprocates in the primary displacement volume chamber in response to the introduced vapor.

5. The system of claim 1, wherein the primary piston comprises a single-action piston or a double-action piston.

6. The system of claim 1, further comprising a connecting rod connecting the primary piston to the double-acting secondary piston, whereby the connecting rod enables reciprocating axial motion between the primary and double-acting secondary pistons.

7. The system of claim 6, wherein the connecting rod connecting the primary displacement volume chamber to a secondary displacement volume chamber through the connecting rod.

8. The system of claim 1, wherein the condenser is in fluid communication with the vapor source through a condensate return conduit.

9. The system of claim 1, wherein the condenser acts on residual vapor on a side of the primary piston opposite a pressurized side turning the vapor to liquid, whereby the volume of the vapor is reduced and a resulting pressure is reduced to a level approaching zero.

10. The system of claim 1, wherein the turbine/motor is in fluid communication with the working fluid pressure tank through a turbine/motor inlet conduit.

11. The system of claim 1, further comprising a pressure sensor operationally attached to an interior of the primary displacement volume, or the primary piston, or both, the pressure sensor controlling at least one valve, the at least one valve regulating vapor that engages the primary cylinder.

12. The system of claim 1, wherein the working fluid reservoir is in fluid communication with the turbine/motor through a turbine/motor outlet conduit.

13. The system of claim 1, wherein the working fluid reservoir is in fluid communication with the working fluid inlet check valve through a working fluid return line and the working fluid inlet check valve.

14. The system of claim 13, wherein the working fluid inlet and outlet check valves includes at least one of the following: a check valve, a clack valve, a non-return valve, a reflux valve, and a one-way valve.

15. The system of claim 1, wherein the pressure ratio is up to 100:1.

16. The system of claim 1, wherein the primary displacement volume chamber, the secondary displacement volume chamber, the working fluid pressure tank, and the working fluid reservoir form a closed loop, whereby introduction of vapor into the primary displacement volume chamber applies a uniform pressure to the primary piston throughout a stroke length of the primary piston, thus pressurizing a working fluid in the secondary displacement volume chamber to a uniform pressure resulting in a steady volume of working fluid at uniform pressures.

17. A uniformly pressurized thermal energy recovery system, comprising:

an internal combustion engine;

a vapor source disposed in thermal contact with the engine or with exhaust gas from the engine, geothermal steam or hot water, or an electric boiler or water heater powered by a photovoltaic array or a solar thermal collector, the vapor source adapted to contain vapor or liquid in such a state so as to become vapor;

a piston assembly including:

a primary displacement volume adapted to receive vapor or liquid in such a state so as to become vapor from the vapor source;

a plurality of vapor metering valves disposed at opposite ends of the primary displacement volume, the vapor metering valves regulating flow rate and pressure of the vapor or liquid into the primary displacement volume, whereby the vapor metering valves enable uniform flow of the vapor into the primary displacement volume;

a double-acting secondary cylinder extending from one end of the primary displacement volume;

a primary piston disposed for displacement in the primary displacement volume;

a secondary double-action piston disposed for displacement in the secondary cylinder a pressure ratio applied to the primary piston and secondary double-action pistons being up to about 100:1, thereby amplifying a pressure exerted on the primary piston raising a pressure of a working liquid in the secondary cylinders sufficient to efficiently power a fluid turbine/motor;

at least one piston connecting member connecting the first and second secondary double-action pistons to the primary piston;

a first cylinder inlet valve and a second cylinder inlet valve disposed in fluid communication with the primary displacement volume, the vapor source disposed in fluid communication with the first cylinder inlet valve and the second cylinder inlet valve through a vapor source outlet conduit connecting the vapor source to the first cylinder inlet valve and the second cylinder inlet valve;

a first cylinder outlet valve and a second cylinder outlet valve disposed in fluid communication with the primary displacement volume;

a condenser disposed in fluid communication with the first cylinder outlet valve and the second cylinder outlet valve, whereby the condenser acts on residual vapor on a side of the primary piston opposite a pressurized side turning the vapor to liquid, hence reducing a volume of the vapor and reducing a resulting pressure to a level approaching zero;

a first inlet check valve disposed in fluid communication with the secondary cylinder, a second inlet check valve disposed in fluid communication with the secondary cylinder and a fluid reservoir disposed in fluid communication with the first inlet check valve and the second inlet check valve;

a first outlet check valve disposed in fluid communication with the secondary cylinder, a second outlet check valve disposed in fluid communication with the secondary cylinder, and a pressure vessel disposed in fluid communication with the first outlet check valve and the second outlet check valve through a working fluid transfer conduit;

a turbine/motor powered by pressurized fluid and having a turbine/motor inlet disposed in fluid communication with the pressure vessel, the turbine/motor further having a turbine/motor outlet disposed in fluid communication with the fluid reservoir, the turbine/motor being at least partially powered by pressurized fluid, the secondary cylinder, the pressure vessel, and the fluid reservoir forming a closed loop, whereby introduction of vapor into the primary displacement volume applies a uniform pressure to the primary piston throughout a stroke length of the primary piston, thus pressurizing a working fluid in the secondary cylinder to a uniform pressure resulting in a steady volume of working fluid at uniform pressures being delivered to the turbine/motor powered by pressurized fluid; and at least one pressure sensor in fluid communication with the pressurized working fluid tank, whereby the sensor is provided to control the inlet valve serving as a throttle to control a flow of vapor or liquid, whereby the pressure sensor and the pressure sensor controlled throttle provide that a volume of the uniformly pressurized working fluid delivered to the turbine/motor remains constant under variable turbine/motor load conditions.

18. The uniformly pressurized thermal energy recovery system of claim 1, further comprising a thermodynamic system having an expansion chamber, whereby the vapor source is generated from a liquid or produces a liquid in a thermodynamic state causing the liquid to become a vapor when introduced into the expansion chamber.

19. The uniformly pressurized thermal energy recovery system of claim 18, wherein the thermodynamic system comprises a heat source selected from the group consisting of a boiler, a heat exchanger, a solar thermal array, a source of geothermal steam and/or hot water, and a nuclear reactor.

20. The uniformly pressurized thermal energy recovery system of claim 17 further comprising a first double-acting cylinder and a second double-acting cylinder, the cylinders extending from opposite ends of the primary displacement volume, the second double-acting cylinder functioning the same as first double-acting cylinder.

* * * * *